US006595839B2

(12) United States Patent
Staver

(10) Patent No.: US 6,595,839 B2
(45) Date of Patent: Jul. 22, 2003

(54) SURFACE TREATMENT TOOL

(76) Inventor: Clifford F. Staver, P.O. Box 172, West Roxbury, MA (US) 02132-1703

( * ) Notice: Subject to any disclaimer, the term of this patent is extended or adjusted under 35 U.S.C. 154(b) by 0 days.

(21) Appl. No.: 09/999,155

(22) Filed: Nov. 15, 2001

(65) Prior Publication Data

US 2003/0092368 A1 May 15, 2003

(51) Int. Cl.[7] ..... B24B 23/00
(52) U.S. Cl. ..... 451/353; 451/359
(58) Field of Search ..... 451/353, 359, 451/548, 158, 549, 540, 508, 509, 550

(56) References Cited

U.S. PATENT DOCUMENTS 3,562,968 A * 2/1971 Johnson et al ..... 451/521
3,852,843 A * 12/1974 Metz ..... 15/93.1
4,457,040 A 7/1984 Hettes
4,461,127 A 7/1984 Hanger
D308,623 S 6/1990 Nishiki
5,438,728 A 8/1995 Kubes et al.
5,468,178 A * 11/1995 Kitko et al. ..... 451/548
5,679,067 A * 10/1997 Johnson et al. ..... 451/527
5,964,006 A 10/1999 Holmes et al.
5,983,434 A 11/1999 Eichinger et al.
6,138,317 A 10/2000 Holmes et al.
6,173,470 B1 1/2001 van Osenbruggen

* cited by examiner

*Primary Examiner*—Dung Van Nguyen
(74) *Attorney, Agent, or Firm*—Lambert & Associates; Gary Lambert; Ed Timmer

(57) ABSTRACT

Provided is a rotary surface treatment tool for removal of paint and other surface substances from such solid materials as wood. The device has a planar circular base which could be attached to a rotational driver via a center spindle. The front side of the base is has a plurality of planar protrusions such as thin flat wires. The protrusions run along the surface of the front side of the base protruding by a few millimeters and lying at an angle to the plane of the base. During operation, the base revolves around a central rotary axis and the front side of the base is applied to the surface to be treated. The planar protrusions positioned on the front side cut into the surface of the object and tear away surface material.

19 Claims, 1 Drawing Sheet

SURFACE TREATMENT TOOL

FIELD OF THE INVENTION

This invention relates to surface treatment tools and particularly to rotary surface treatment tools.

The term "surface treatment" refers to any sort of treatment of a surface of a solid object wherein it is desirable to remove surface paint or rust or any other type of a surface layer. In the past, a variety of devices were utilized for such purposes. However, such devices were plagued with a common problem of not being capable of remaining functional over a prolonged period of time. Among very common prior art devices is a sanding disc, which is attached to a rotational driver such as drill. The sanding disc would get clogged up with paint after a very short period of use and thus become useless, having lost its abrasive surface quality. Other surface treatment tools use brush attachments which have a common problem of bending of brush hairs as they press against the work surface thus losing much of the surface removing grip on the work surface. What is a needed is a simple and inexpensively manufactured surface treatment tool which would be effective in paint removal and at the same time remain operational over a prolonged period of use.

SUMMARY OF THE INVENTION

The present invention represents a rotary surface treatment tool for removal of paint and other surface substances from such solid materials as wood. The device has a planar circular base which could be attached to a rotational driver via a center spindle. The front side of the base has a plurality of planar protrusions such as thin flat wires. The protrusions run along the surface of the front side of the base protruding by a few millimeters and lying at an angle to the plane of the base. During operation, the base revolves around a central rotary axis and the front side of the base is applied to the surface to be treated. The planar protrusions positioned on the front side cut into the surface of the object and tear away surface material. Unlike brush hairs of brush utilizing surface treatment tools, the protrusions of the disclosed device are solid enough to remain relatively fixed in their orientation to the base and the work surface during operation. This translates into a constant angle of bite into the work surface. The disclosed device works especially well for removal of paint from wood surfaces.

BRIEF DESCRIPTION OF DRAWINGS

These and other features, aspects and advantages of the present invention will become better understood with reference to the following description, appended claims, and accompanying drawings where:

DESCRIPTION OF THE INVENTION

This invention represents a surface treatment tool.

Figure 1:
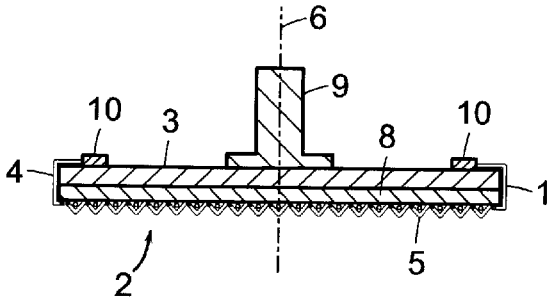
FIG. 1 is a side cross-sectional view of one of the embodiments of the surface treatment tool.

The basic components, as depicted in FIG. 1, are a generally planar circular base 1 having an axis of rotation 6.

The base 1 has a front side 2, a drive side 3, and an edge 4. A center spindle is attached to the drive side 3 and it lies in the axis of rotation 6. The front side 2 has a plurality of planar protrusions 5. The protrusions 5 are flat and run along the surface of the front side 3. They could be forming parallel and/or intersecting patterns on the surface of the front side 3. For optimal performance, the planar protrusions 5 are approximately 1–3 mm in height. The protrusions 5 could be either all of uniform height throughout the surface of the front side 2 or they could have a repeating raising and lowering height pattern. The protrusions 5 are made out of solid material which does not readily bend under pressure of contact with the work surface. The protrusions 5 could be affixed to the front side 2. Alternatively, the protrusions 5 can extend in length beyond the area of the front side 2, bend over the edge 4, and be affixed to the drive side 3 of the base 1 as depicted in FIG. 1.

The plane of orientation of the protrusions 5 is at an angle to the base 1. Almost any angle would work but for best results an angle of 45°–135° is preferred.

To perform work, the base 1 is attached to a rotational driver via center spindle 9. The rotational driver is turned on and the base 1 starts spinning around the central rotary axis 6. The front side 2 is then applied to the material that needs to be treated. The planar protrusions 5 cut into the surface and peel away surface materials such as paint. The resulting treated surface is free of the previous surface material and has a smooth texture. There is no accumulation of removed paint on the front side 2 if the planar protrusions 5 are spaced apart at distance greater than a few millimeters.

DESCRIPTION OF THE PREFERRED EMBODIMENT

Figure 2:
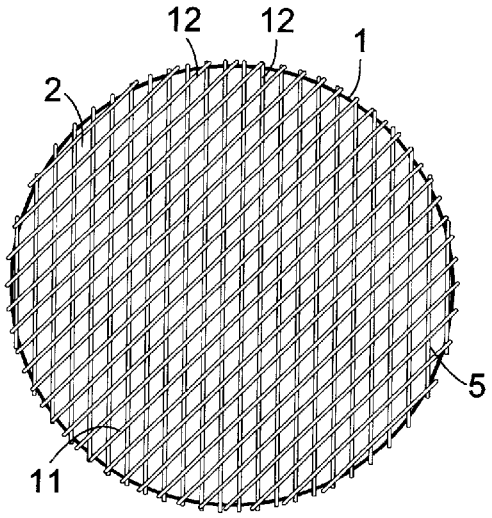
FIG. 2 is a front view of the preferred embodiment of the surface treatment tool with wire lath attached to the front side of the base.
Figure 3:
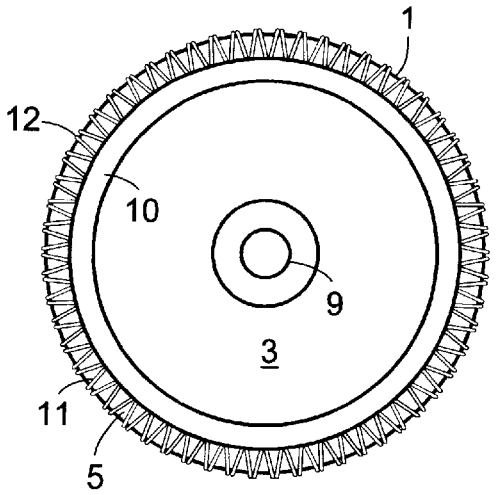
FIG. 3 is a back view of the preferred embodiment of the surface treatment tool with wire lath attached to the front side of the base showing use of epoxy type of glue to secure the wire lath to the base.

The preferred embodiment of the invention is shown in FIGS. 2 and 3. Here, the planar protrusions 5 are created by a cutout of a wire lath 11 attached to the base 1. The wire lath 11 is made up of overlying component wires 12 forming a honeycomb-like pattern. The component wires 12 of the wire lath 11 could be corrugated to each other at the intersection points. The wire lath 11 lies along the surface of the front side 2 with its terminal edges bend over the edge 4 of the base and secured to the drive side 3 of the base 1. Such materials as epoxy type of glues 10 work well for this purpose of securing the wire lath 11 onto the base 1.

An additional elastic layer 8 could be inserted between the wire lath 11 and the base 1 on the front side 2 so as to provide a more responsive working surface. The addition of the elastic layer 8 results in cushioning effect and smoother operation of the tool.

What is claimed is:

1. A surface treatment tool comprising:

a generally planar circular base, having a drive side for attachment to a rotational driver, an edge, and a front side opposite the drive side, the base having a central rotary axis;

a wire lath made up of overlying component wires, positioned on the front side of the base and affixed to the base.

2. The surface treatment tool of claim 1 wherein:

an elastic layer is affixed to the base on the front side of the base between the base and the wire lath.

3. The surface treatment tool of claim 1 wherein:

the section of wire lath extends beyond the surface of the front side of the base and wraps over the edge while being affixed to the base on the driver side of the base.

4. The surface treatment tool of claim 3 wherein:

the section of wire lath is affixed to the base by epoxy type glue.

5. The surface treatment tool of claim 1 wherein:

the component wires of the wire lath are corrugated to each other at period intervals along the length of the component wires.

6. The surface treatment tool of claim 1 wherein:

the component wires of the wire lath overlie in a honeycomb pattern.

7. A surface treatment tool comprising:

a generally planar circular base, having a drive side for attachment to a rotational driver, an edge, and a front side opposite the drive side, the base having a central rotary axis;

a plurality of planar protrusions positioned on the front side and having a plane of orientation that is at an angle to the plane of the circular base;

the planar protrusions are formed by at least a single section of wire lath affixed to the base and positioned on the front side of the base, wherein the wire lath is made up of overlying component wires.

8. The surface treatment tool of claim 7 wherein:

the section of wire lath extends beyond the surface of the front side of the base and wraps over the edge while being affixed to the base on the driver side of the base.

9. The surface treatment tool of claim 8 wherein:

the section of wire lath is affixed to the base by epoxy type glue.

10. The surface treatment tool of claim 7 wherein: the plane of each planar protrusion lies at a 45° to 135° angle to the plane of the base.

11. The surface treatment tool of claim 7 wherein:

the planar protrusions are integral with the base.

12. The surface treatment tool of claim 7 wherein:

an elastic layer is affixed to the base on the front side of the base between the base and the planar protrusions.

13. The surface treatment tool of claim 7 wherein:

a center spindle is centrally affixed to the base on the drive side for attachment to a rotational driver.

14. The surface treatment tool of claim 7 wherein:

the planar protrusions cover the entire front side of the base.

15. The surface treatment tool of claim 7 wherein:

the base is made out of a flexible material.

16. The surface treatment tool of claim 7 wherein:

the base is made out of a solid non-flexible material.

17. A surface treatment tool comprising:

a generally planar circular base, having a drive side for attachment to a rotational driver, an edge, and a front side opposite the drive side, the base having a central rotary axis;

a plurality of planar protrusions positioned on the front side and having a plane of orientation that is at an angle to the plane of the circular base;

the planar protrusions extend in their length beyond the area of the front side of the base and wrap over the edge while being affixed to the base on the driver side of the base.

18. The surface treatment tool of claim 17 wherein:

the planar protrusions are affixed to the base by epoxy type glue.

19. A surface treatment tool comprising:

a generally planar circular base, having a drive side for attachment to a rotational driver, an edge, and a front side opposite the drive side, the base having a central rotary axis;

a plurality of planar protrusions positioned on the front side and having a plane of orientation that is at an angle to the plane of the circular base;

the planar protrusions are solid strips of flat wire.

* * * * *